United States Patent [19]

Berndt et al.

[11] 4,054,145

[45] Oct. 18, 1977

[54] METHOD AND APPARATUS FOR CONDITIONING TOBACCO

[75] Inventors: Wolfgang Berndt; Heinz Wittkugel; Waldemar Wochnowski, all of Hamburg; Gustav Hancke, Hamburg-Meiendorf, all of Germany

[73] Assignee: Hauni-Werke Körber & Co., KG, Hamburg, Germany

[21] Appl. No.: 271,532

[22] Filed: July 13, 1972

[30] Foreign Application Priority Data

July 16, 1971 Germany ..... 2135637

[51] Int. Cl.[2] ..... A24B 3/00

[52] U.S. Cl. ..... 131/138; 131/140 R

[58] Field of Search ..... 131/21 R, 21 A, 133–138, 131/109, 110; 209/120

[56] References Cited

U.S. PATENT DOCUMENTS

| | | | |
|---|---|---|---|
| 1,326,547 | 12/1919 | Teale | 131/110 X |
| 1,757,477 | 5/1930 | Rosenhoch | 131/136 UX |
| 2,553,234 | 5/1951 | Boucher | 209/120 X |
| 2,768,629 | 10/1956 | Maul | 131/135 |
| 2,827,058 | 3/1958 | Bogaty | 131/138 UX |
| 3,062,357 | 11/1962 | Molins | 131/21 A |
| 3,098,572 | 7/1963 | Quester | 131/21 R X |
| 3,173,861 | 3/1965 | Hager et al. | 131/110 X |
| 3,372,488 | 3/1968 | Koch et al. | 131/136 X |
| 3,419,015 | 12/1968 | Wochnowski | 131/138 |
| 3,494,367 | 2/1970 | Maguire | 131/135 |

FOREIGN PATENT DOCUMENTS

| | | | |
|---|---|---|---|
| 729,240 | 4/1932 | France | 131/138 |

*Primary Examiner*—Robert W. Michell
*Assistant Examiner*—V. Millin
*Attorney, Agent, or Firm*—Peter K. Kontler; John Kurucz

[57] ABSTRACT

Particles of a continuous tobacco stream are intimately contacted with and thus conditioned by finely distributed solid or fluid additives in a rotary drum into which the additives are supplied by one or more spray nozzles. Tobacco particles are propelled into the drum by a rotary winnower or by an impeller nozzle which discharges a current of compressed air. The flight spans of tobacco particles can be varied by changing the speed of the winnower or by changing the pressure of air which issues from the impeller nozzle. The weight of tobacco which is being fed to the winnower or impeller nozzle per unit of time is measured, and the results of such measurements are used to regulate the flight spans of propelled tobacco particles and the quantity of additives which are admitted into the drum per unit of time. The impeller nozzle or the winnower insures at least nearly complete separation of particles of tobacco during travel across a contact zone into which the spray nozzles discharge one or more finely dispersed additives, such as water, casing, flavoring agents or flowable solid additives.

8 Claims, 2 Drawing Figures

METHOD AND APPARATUS FOR CONDITIONING TOBACCO

BACKGROUND OF THE INVENTION

The present invention relates to a method and apparatus for conditioning tobacco. More particularly, the invention relates to improvements in a method and apparatus for contacting particles of tobacco with additives to thus change the condition and/or characteristics of tobacco particles. Still more particularly, the invention relates to improvements in a method and apparatus for producing a homogeneous mixture of tobacco particles and one or more types of comminuted solid, liquid and/or gaseous additives.

Prior to being fed into a processing machine to be converted into cigarettes, cigars, cigarillos, pipe tobacco or cheroots, particles of tobacco are normally subjected to one or more treatments which usually involve conditioning and comminuting or cutting. The conditioning of tobacco includes the admission of various additives such as moisture in the form of steam, vapors or water, liquid aromatic or flavoring substances and/or pulverulent additives.

Particles of tobacco are normally conditioned in slightly inclined hollow rotary drums, known as moistening, casing or flavoring drums. The axes of drums are inclined downwardly in the direction of transport of tobacco therethrough and their inlet ends receive tobacco particles in the form of whole leaves, tobacco leaf laminae, tobacco shreds, fragments of reconstituted tobacco, fragments of or entire ribs and/or a mixture of two or more types of tobacco particles. Such particles are caused to pass through and toward the discharge end of the revolving drum to be contacted by additives which are discharged by one or more atomizing, spreading or analogous supplying devices installed in the interior of the drum and normally at a level above the path for the tobacco particles. The nature of additive supplying devices depends on the type of additives; for example, the supplying devices may be steam discharging nozzles, nozzles which discharge atomized flavoring agents, casing agents, water and/or other liquids, and/or revolving wheels for uniform distribution of pulverulent additives. The nature of finely distributed additives depends on their composition, i.e., the additives may be minute globules of liquid, aerosols, solid particles or gases. The region in which the particles of tobacco passing through the revolving drum are contacted by additives is called the contact zone.

The revolving drum is further provided with internal entraining means in the form of heating or cooling pipes, paddles, blades, ribs or the like which serve to turn and/or agitate the travelling particles to thus promote contact between additives and all sides of the particles. It was found that such mode of agitating tobacco particles in a revolving drum does not insure uniform contact of additives with all sides of each particle because the turning action of blades, coils, paddles or like mechanical devices is neither uniform nor capable of insuring satisfactory agitation of each and every particle during travel from the inlet to the discharge end of the drum. Therefore, a substantial percentage of additives, particularly atomized liquids, invariably misses the tobacco particles and deposits on the internal surface of the drum.

SUMMARY OF THE INVENTION

An object of the invention is to provide a novel and improved method of contacting particles of tobacco with one or more finely dispersed or atomized fluid and/or solid additives in such a way that the homogeneousness of the resulting mixture is much more satisfactory than that of mixtures which are produced in accordance with heretofore known methods.

Another object of the invention is to provide a method which can be practiced with equal advantage for conditioning of many types and sizes of tobacco particles including whole leaves, laminae, entire ribs or stem, fragments of ribs or stem, shreds, comminuted reconstituted tobacco sheets and/or others.

A further object of the invention is to provide a method of contacting tobacco particles with one or more finely dispersed additives in such a way that the additives can contact all sides of all or nearly all particles and that the conditioning need not entail undesirable fragmentizing, formation of tobacco dust and/or caking of tobacco.

An additional object of the invention is to provide a novel and improved tobacco conditioning apparatus which can treat large quantities of tobacco per unit of time, which can automatically compensate for eventual fluctuations in the rate of feed of tobacco particles and/or additives, which is capable of loosening the tobacco prior to and/or during contact with additives, and which can be used as a superior substitute for presently known conditioning apparatus.

Still another object of the invention is to provide a conditioning apparatus which can be rapidly converted for treatment of different types of tobacco, for admission of different types of additives, and for conditioning of tobacco at a desired rate.

An ancillary object of the invention is to provide a conditioning apparatus which is capable of insuring uniform distribution of additives among and on tobacco particles even if the particles which are to be contacted with additives are of varying size, weight and/or shape.

The method of the present invention can be resorted to for contacting of tobacco with at least one additive to thereby change the condition (e.g., the moisture content, the flavor and/or aroma) of tobacco. The method comprises the steps of continuously supplying into a predetermined contact zone (which is preferably of variable volume) at least one spray of finely dispersed solid and/or fluid additive, and moving across the contact zone a continuous body (e.g., a shower) of at least substantially separated tobacco particles whereby the particles are intimately contacted and conditioned by the dispersed additive. The moving step may comprise mechanically propelling the particles of tobacco across the contact zone, e.g., by means of one or more winnowers which can be driven at a plurality of speeds to change the length of flight spans of tobacco particles, preferably as a function of changes in the rate of tobacco feed to the winnower or winnowers per unit of time. Alternatively, the moving step may comprise feeding the particles of tobacco into a current of a pressurized fluid carrier, e.g., compressed air.

The winnower or the current of gaseous carrier propels the particles of tobacco from a location without the contact zone so that the particles have flight spans which extend across the contact zone. The tobacco particles are preferably fed to such location in the form of a continuous stream and the rate of tobacco feed to the location is measured by a weighing or like device which is capable of furnishing signals indicating the momentary rate of tobacco feed. The flight spans of propelled tobacco particles can be changed in response to such signals so that the flight spans are longer when the measured rate of tobacco feed exceeds a predetermined rate and that the flight spans are shortened when the rate of feed is less than the predetermined rate. The rate of delivery of dispersed additive or additives into the contact zone is preferably varied as a function of changes in the rate of tobacco feed to the winnower or into the current of pressurized fluid carrier. The additive may consist of water, casing, liquid flavoring agents and/or flowable solid substances.

The changes in the rate of delivery of dispersed additive are preferably accompanied by changes in the volume or area of the contact zone. This can be achieved by discharging the additive through one or more spray nozzles or by one or more revolving distributing and dispersing devices and by changing the number of active spray nozzles and/or rotary distributing devices in response to changes in the rate of tobacco feed.

DESCRIPTION OF THE PREFERRED EMBODIMENTS

Figure 1:
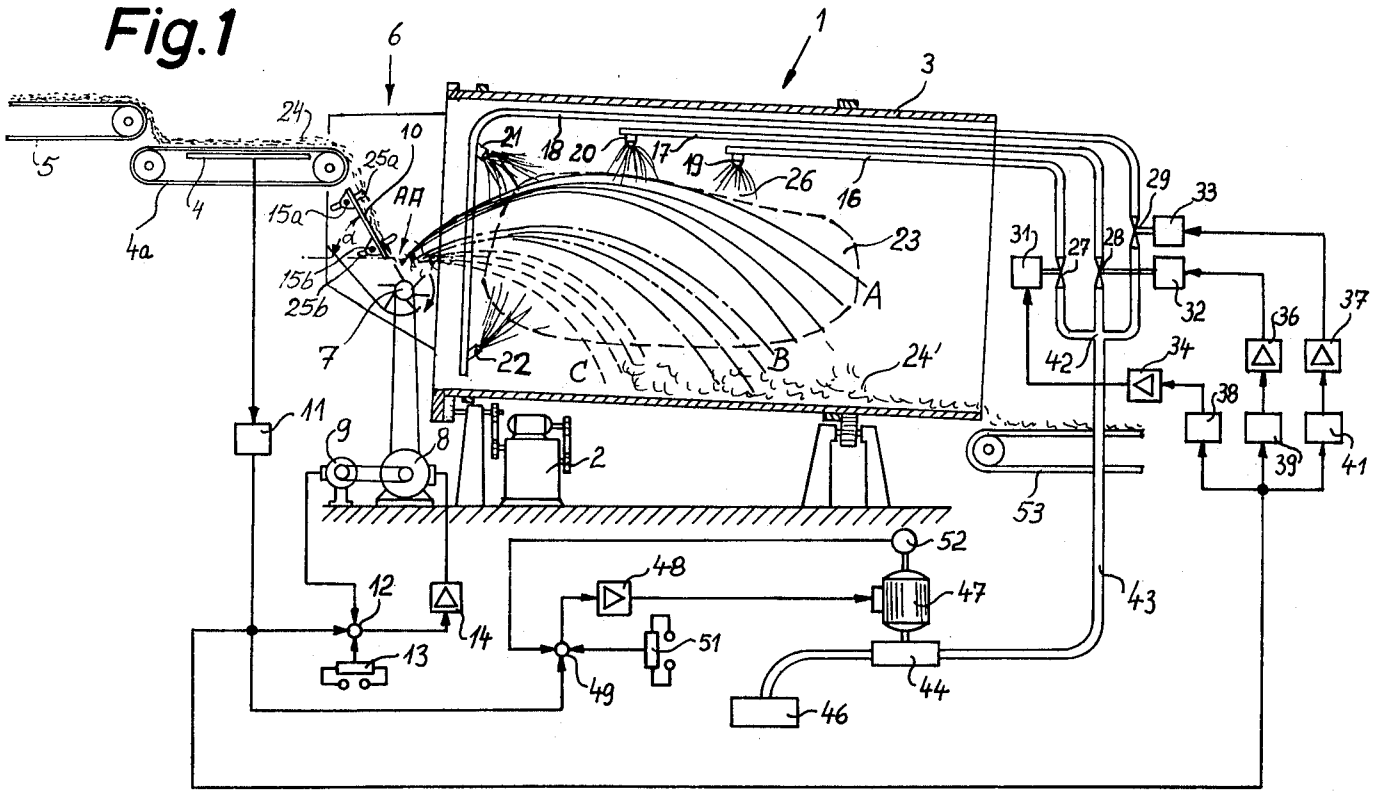
FIG. 1 is a diagrammatic partly elevational and partly longitudinal vertical sectional view of a conditioning apparatus which embodies one form of the invention.

Referring first to FIG. 1, there is shown a tobacco conditioning apparatus which comprises a hollow rotary drum 1 wherein the particles of a continuous tobacco stream 24 are contacted with water, casing and/or other dispersible additives. The open-ended cylindrical body 3 of the drum 1 is provided with a ring gear meshing with a pinion which is driven by a variable-speed motor or transmission 2. The tobacco stream 24 is fed by a conveyor system including an endless belt 4*a* which cooperates with a suitable weighing device 4 serving to produce signals representing the weight of successive increments of the tobacco stream and more particularly the rate of tobacco feed per unit of time. The upper stretch of the belt 4*a* receives the tobacco stream 24 from a second endless belt 5 of the conveyor system. The weighing device 4 constitutes but one of various monitoring means which can be used to determine fluctuations in the rate of tobacco feed toward the inlet end of the drum 1. For example, this weighing device can be replaced with a detector employing a source of corpuscular radiation and a suitable receiver, a high-frequency gauge and/or others.

The discharge end of the endless belt 4 extends into a channel or duct 6 the lower portion of which accommodates an impeller here shown as a rapidly rotating adjustable winnower 7 serving to propel the particles in successive increments of the tobacco stream 24 from a location AA outside of the drum 1 into the interior of the cylindrical body 3 with attendant pronounced loosening or separation of normally interleaved or interlaced particles. The duct 6 has side walls which flank the trajectories of the tobacco particles between the winnower 7 and the inlet end of the drum 1. This duct further accommodates a suitably inclined adjustable chute 10 forming part of the aforementioned conveyor system and consisting of sheet metal or the like. The chute 10 guides the particles of tobacco from the discharge end of the belt 4 into the range of paddles, ribs or analogous projections on the periphery of the winnower 7. The chute 10 is adjustable to allow for changes in its inclination relative to the axis of the winnower 7; to this end, the chute is provided with transversely extending threaded spindles 15*a*, 15*b* extending laterally through elongated slots 25*a*, 25*b* of the chute to be held in selected positions by means of nuts, not shown, which mesh with the spindles. The adjustability of the chute 10 is preferably such that the attendant can select the inclination (see the angle alpha) of the downwardly sloping tobacco guiding surface of the chute as well as the location AA where the particles of tobacco enter the path of projections on the periphery of the winnower 7. Such adjustability of the chute 10 renders it possible to influence the trajectories of tobacco particles in dependency on their weight size and/or shape.

The winnower 7 is driven by a regulating means here shown as a d-c motor 8 and the speed of the output shaft of the motor 8 is monitored by a conventional tachometer generator 9. The signals furnished by tachometer generator 9 and indicating the momentary RPM of the motor 8 are transmitted to a signal comparing junction 12. The signals which are furnished by the weighting device 4 are converted into electrical signals by a transducer 11 which is connected with a second signal comparing junction 49. The signals from the transducer 11 are further transmitted to the junction 12. The latter is also connected with a rated value selector 13, e.g., an adjustable potentiometer, and the signal from the junction 12 serves to regulate the speed of the motor 8 by way of an operational amplifier 14. Thus; the intensity of the signals transmitted by the junction 12 to the amplifier 14 is a function of the weight of unit lengths of the tobacco stream 24 on the belt 4*a*, of the detected speed of the motor 8 and of the signal furnished by the potentiometer 13.

The upper portion of the cylindrical body 3 (which is slightly inclined downwardly as considered in the direction of tobacco transport from the duct 6 toward the discharge end of the conveyor 1) accommodates portions of three preferably parallel conduits 16, 17 and 18 which are respectively provided with additive delivering means here shown as spray nozzles or atomizing nozzles 19, 20 and 21–22. The conduits 16–18 are stationary and the distribution of their nozzles 19–22 is such that the atomized additive or additives issuing from the orifices of these nozzles come into contact with loosened particles of tobacco in a contact zone 23 which is indicated by broken lines. The finely dispersed or atomized additive is indicated at 26 and the flight spans or trajectories of tobacco particles forming the stream 24 are indicated at A, B and C. The trajectory A is the longest, the trajectory B is of medium length, and the trajectory C is the shortest. The atomizing action of nozzles 19–22 is preferably such that the droplets and/or particles 26 of additive form a fog, cloud or spray capable of coming into contact with all sides of all or nearly all tobacco particles which are being propelled into the contact zone 23 by winnower 7.

Those portions of the conduits 16, 17, 18 which are located without the cylindrical body 3 of the drum 1 are respectively provided with shutoff valves 27, 28, 29 which can be respectively actuated by servomotors 31, 32, 33. These servomotors respectively receive signals by way of amplifiers 34, 36, 37 which, in turn, receive signals from suitable circuits 38, 39, 41, e.g., Schmitt triggers. As known, a Schmitt trigger is an electronic circuit which produces an output signal when the intensity of input signal reaches a predetermined threshold value which may but need not be adjustable. It is assumed that the setting of each of the three Schmitt triggers 38, 39, 41 is different, and the inputs of these circuits are connected with the transducer 11.

The conduits 16, 17, 18 branch from a supply pipe 43, as at 42, and the supply pipe receives a suitable additive from a variable-delivery pump 44 which draws the additive from a source 46 (e.g., a tank) and is driven by a variable-speed motor 47. The motor 47 receives signals from the junction 49 by way of an amplifier 48 and is kinematically connected with a tachometer generator 52 serving to transmit signals to the junction 49. The latter further receives signals from a second rated value selector 51, e.g., an adjustable potentiometer. It is assumed that the additive which is stored in the tank 46 is water but it is clear that this tank can store a supply of liquid casing or other additive which can be used to change the condition, taste and/or aroma of tobacco.

The reference character 53 denotes an endless collecting and transporting conveyor which serves to receive and remove conditioned tobacco 24' which is discharged at the righthand open end of the cylindrical body 3 of the drum 1.

The operation is as follows:

The belt 5 delivers a continuous tobacco stream 24 (e.g., a stream consisting of tobacco leaves or tobacco leaf laminae onto the upper stretch of the belt 4a, and successive increments of the stream travel along the downwardly inclined guide surface of the chute 10 to move into the range of the winnower 7 which is driven by the motor 8. Those particles of the stream 24 which adhere to each other during travel toward the winnower 7 (which rotates in a clockwise direction, as viewed in FIG. 1) are separated from each other during travel into the drum 1, especially if they have different weights so that the flight spans of the heavier particles are normally longer than those of the lighter particles. The length of flight spans or trajectories of tobacco particles depends on rotational speed of the winnower 7 and hence on the RPM of the motor 8.

If the tobacco stream 24 passing along the upper stretch of the belt 4a contains relatively large quantities of tobacco particles per unit length, the signal from the weighing device 4 is indicative of the greater weight of increments of unit length and the signal from the transducer 11 causes the motor 8 to rotate the winnower 7 at a relatively high speed. The speed of the winnower 7 is preferably adjustable between an infinite number of speeds, and each such speed corresponds to a different trajectory for a given tobacco particle. Thus, by changing the speed of the motor 8, the apparatus can cause the winnower 7 to propel tobacco particles along a relatively long trajectory (such as A), a trajectory (such as B) of medium length, or a short trajectory (such as C). As mentioned before, and particularly when the weight of all particles of the stream 24 at least approaches an average weight, infinite adjustments in the speed of the winnower 7 can cause the latter to propel the particles along any one of an infinite number of trajectories. It will be seen that, in the apparatus of FIG. 1, the length of trajectories of tobacco particles into the drum 1 is directly proportional to the combined weight of tobacco particles in unit lengths of the stream 24 or to the rate of tobacco particle feed per unit of time. Such relationship between the trajectories and the rate of tobacco feed into the range of the winnower 7 insures that the density of the tobacco body or shower in the contact zone 23 remains at least substantially constant. In other words, when the belt 5 supplies tobacco at a higher rate, the spreading action of the winnower 7 is more pronounced and the shower or body of tobacco in the interior of the cylindrical drum body 3 is wider and longer whereby the density of the shower changes very little or not at all. This renders it possible to contact all or nearly all particles of tobacco in the zone 23 with an optimum quantity of dispersed additive, e.g., water or casing.

If the rate of tobacco feed into the range of the winnower 7 is reduced to a minimum, the signal from the detector 4 causes the junction 12 to furnish to the amplifier 14 a signal which results in deceleration of the motor 8 and winnower 7 so that the tobacco particles entering the drum 1 have very short trajectories (see the trajectory C). At the same time, the troughput of the pump 44 is reduced so that the ratio of tobacco to additive or additives in the material reaching the collecting conveyor 53 remains unchanged. The signal from the transducer 11 is transmitted to the Schmitt trigers 38, 39, 41 whereby the trigger 41 furnishes a signal which opens the valve 29 by way of the amplifier 37 and servomotor 33. The signals furnished to the Schmitt triggers 38 and 39 are too weak to cause an opening of the valves 27 and 28 so that only the nozzles 21, 22 discharge atomized liquid additive into the contact zone 23. The volume of this contact zone is then minimal because it encompasses only the space which receives additive from the nozzles 21 and 22.

If the rate of tobacco feed from the belt 5 to the upper stretch of the belt 4a increases, the intensity of the signal furnished by the weighing device 4 increases with the result that the intensity of signals furnished by the junctions 12 and 49 increases. Therefore, the motor 8 drives the winnower 7 at a higher speed and the output signal from the junction 49 causes the amplifier 48 to accelerate the pump motor 47 so that the rate of delivery of additive by pump 44 into the supply pipe 43 increases. The winnower 7 lengthens the flight spans of tobacco particles (e.g., to B) and the signal furnished to the Schmitt triggers 38, 39, 41 is strong enough to effect an opening of the valves 29 and 28 so that the atomized additive is delivered into an enlarged contact zone 23 by way of three nozzles (20, 21 and 22). The threshold value of signals for the inputs of the Schmitt triggers may be selected in such a way that the valve 29 opens when the trajectories of tobacco particles correspond to that shown at C, that the valve 28 opens (while the valve 29 remains open) when the trajectories correspond to that shown at B, and that the valve 27 opens (while the valves 28, 29 remain open) when the trajectories correspond to that shown at A. Thus, when the tobacco is being delivered at a maximum rate the flight spans of tobacco particles are longest, the additive is being delivered from all four nozzles (maximum volume of the contact zone 23) and the pump 44 delivers additive at a maximum rate.

The speed of the motors 8 and 47 decreases in automatic response to a reduction in the rate of tobacco delivery onto the upper stretch of the belt 4a because the signal from the transducer 11 then causes the junctions 12, 49 to change the intensities of signals which are transmitted to the amplifiers 14, 48. At the same time, the signal from the transducer 11 directly influences the Schmitt triggers 38, 39, 41. It will be noted that the volume of the contact zone 23 varies as a function of changes in the weight of unit lengths of the tobacco stream 24, and that changes in the volume of contact zone 23 take place simultaneously with changes in the speed of motors 8, 47 and with changes in the number of actuated additive-admitting valves.

The particles of the tobacco stream 24 which is being supplied by the belt 5 are at least partially interlaced so that, in the absence of any loosening or separating action, the interlaced particles would adhere to each other during travel through the drum 1. The winnower 7 brings about a very pronounced separating action to thus insure that at least the major percentage of particles which form the stream 24 will be completely separated from each other not later than during travel across the contact zone 23 whereby the thus separated particles are much more likely to be contacted from all sides by finely dispersed additive issuing from one, two or more spray nozzles 19–22. The weighing of successive unit lengths of the tobacco stream 24 on the belt **4*a* or of tobacco which passes through the weighing station per unit of time is the presently preferred mode of detecting fluctuations in the rate of tobacco feed into the range of the winnower 7. However, and especially if the stream 24 contains tobacco particles in uniform distribution, the weighing device 4 can be replaced by one or more photoelectric detectors which serve to detect changes in the height of the stream 24** and/or by one or more detectors capable of detecting changes in the volume of unit lengths of the stream.

Uniform distribution of additives on all sides of the particles which form the stream 24 is particularly important if the particles are rather large, e.g., whole tobacco leaves or tobacco leaf laminae. For example, uniform moistening of tobacco leaves will not be insured if some or all of the leaves are contacted by atomized water at one side only or if certain leaves are not wetted at all.

The action of a mechanical impeller, such as the winnower 7, is particularly beneficial when the stream 24 consists of destalked or comminuted tobacco leaves. During travel from the winnower 7, across the contact zone 23 and toward the internal surface of the rotating cylindrical body 3, the propelled tobacco leaves travel along separate paths and are therefore ready to be contacted at all sides by sprays of one or more additives.

The monitoring of the stream 24 prior to entering the drum 1 is desirable because proper conditioning of tobacco can be achieved only if the rate of admission of additive into the contact zone 23 varies proportionally with the rate of admission of tobacco. The quantity of tobacco particles per unit length of the stream 24 is likely to vary for a number of reasons, e.g., due to varying degree of interlacing of tobacco particles, due to changes in the shape, size and/or weight of particles, and/or due to changes in the level of tobacco in the source from which the stream 24 is being withdrawn. Were the winnower 7 rotated at a constant speed, it would be unable to effect the same separation of particles in successive increments of relatively large and relatively small tobacco streams. In other words, the particles of a relatively large stream would continue to adhere to each other and the uniformity of contact with a finely distributed additive would be much less satisfactory than in the case of feed of a relatively small tobacco stream. It was found that the feature of automatically regulating the speed of the winnower (i.e., the intensity of separating action) as a function of changes in the rate of tobacco feed constitutes a very simple and highly efficient solution of the problem of insuring that the separation of particles entering into and moving across the contact zone 23 is not affected by such changes in the rate of tobacco feed.

The variable delivery pump 44 insures that the quantity of dispersed additive which is being delivered into the contact zone 23 per unit of time varies proportionally with the quantity of tobacco particles entering the zone 23 per unit of time. It can be said that the rate of delivery of dispersed additive is a function of the length of flight spans of tobacco particles and hence a function of changes in the rate of tobacco feed into the range of the winnower 7.

The acceleration of tobacco particles on their way into the contact zone 23 should be effected by means which is not likely to fragmentize the particles because it is normally desirable to subject the conditioned tobacco stream 24' to further treatment while the size of its particles is as large as possible. It was found that a winnower is ideally suited for use as an impeller upstream of the contact zone 23, not only because it is not likely to fragmentize the tobacco particles but also because it is capable of subjecting similar particles to identical or nearly identical accelerating action as well as because its accelerating action (and hence the length of trajectories of the particles) can be regulated with a high degree of accuracy by the simple expedient of changing its rotational speed. By changing the length of trajectories of tobacco particles, the winnower 7 insures that the density of the tobacco shower or body in the contact zone 23 is independent of fluctuations in the rate of tobacco feed per unit of time.

The volume of the contact zone 23 depends on the number of active spray nozzles and, therefore, such volume is also a function of the rate of tobacco feed per unit of time because the number of active nozzles in the cylindrical body 3 varies with changes in the intensity of signal furnished by the transducer 11. The changes in volume of the contact zone 23 are at least substantially proportional to changes in the quantity of dispensed additive per unit of time.

The adjustable chute 10 insures that the flight spans of tobacco particles can be changes as a function of changes in the size, shape and/or weight of tobacco particles. It is normally sufficient to change the inclination of the chute 10 but the adjustability of this chute in directions toward and away from as well as circumferentially of the winnower 7 allows for more precise adjustment in the length of flight spans by enabling the operator to select the exact location where the particles furnished by the chute 10 enter the range of the revolving winnower.

Figure 2:
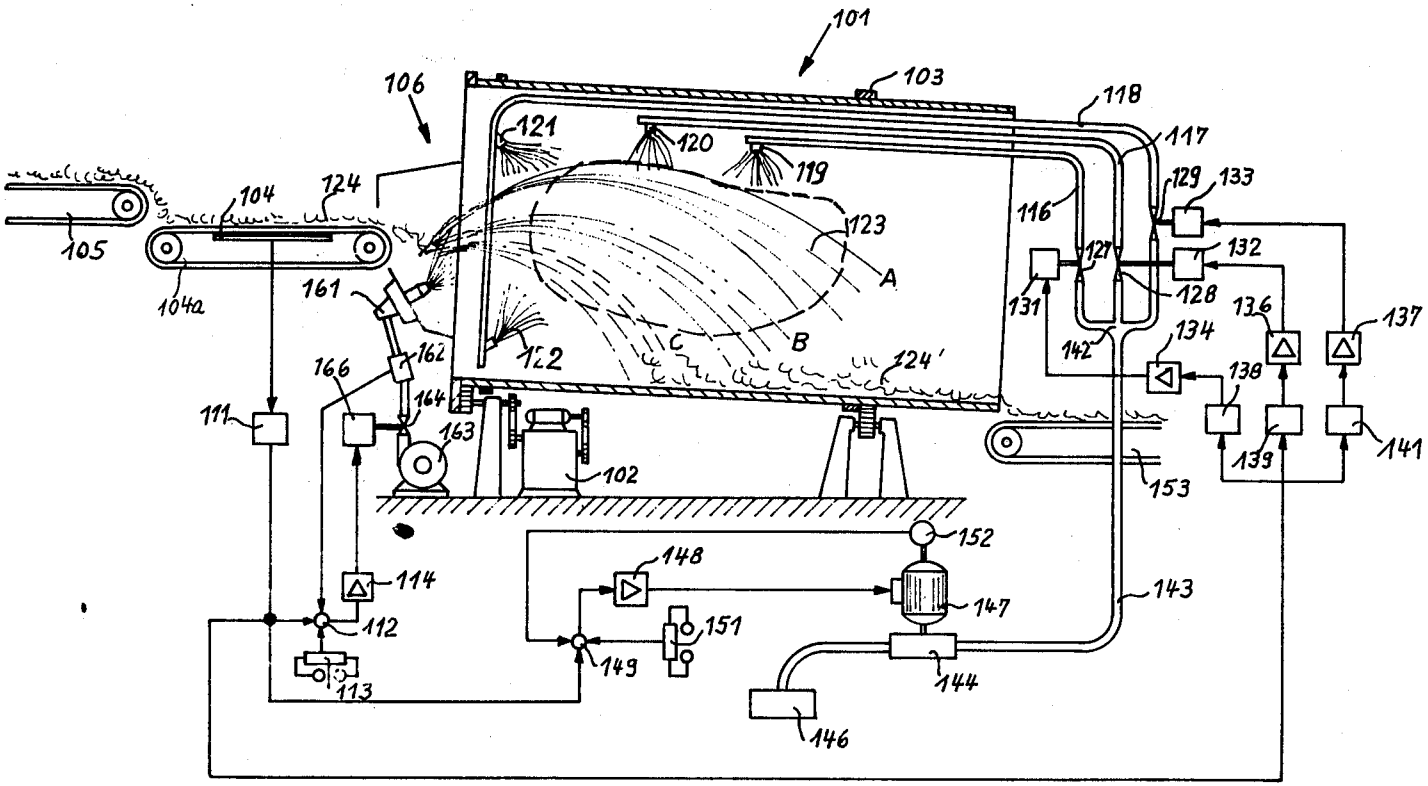
FIG. 2 is a similar partly elevational and partly longitudinal vertical sectional view of a second conditioning apparatus.

The apparatus of FIG. 2 differs from the first apparatus mainly in that the winnower 7 is replaced by a pneumatic impeller nozzle 161. All such parts of the apparatus of FIG. 2 which are identical with or clearly analogous to the corresponding parts of the first apparatus are denoted by similar reference characters plus 100. The nozzle 161 is mounted on the duct 106 and receives a pressurized fluid carrier by way of a pressure gauge 162, e.g., a venturi. The source of pressurized fluid carrier (e.g., compressed air) is a blower 163 and the conduit between the outlet of the blower 163 and the gauge 162 contains an adjustable regulating valve 164. The means for adjusting the valve 164 comprises a servomotor 166 which receives impulses from the junction 112 by way of the amplifier 114.

The tobacco stream 124 which travels along the upper stretch of the endless belt 104*a* descends directly into the current of gaseous carrier issuing from the nozzle 161. However, the apparatus of FIG. 2 can also include an adjustable chute similar to the chute 10 of FIG. 1.

The operation of the apparatus of FIG. 2 is analogous to that of the first apparatus. The weighing device 104 determines the weight of unit lengths of the tobacco stream 124 and furnishes signals to the transducer 111 which in turn furnishes signals to the junctions 112, 149 and to the Schmitt triggers 138, 139, 141. The pressure of carrier issuing from the nozzle 161 is regulated by the valve 164 as a function of the weight of unit lengths of the stream 124 whereby the nozzle 161 determines the length of flight spans of tobacco particles which enter the revolving cylindrical body 103 of the drum 101. At the same time, the signal furnished by the transducer 111 to the Schmitt triggers 138, 139, 141 determines the number of active spray nozzles which deliver dispersed additive into the contact zone 123. The delivery of pump 144 also varies as a function of changes in the weight of unit lengths of the stream 124.

An important advantage of the improved conditioning apparatus is that the mechanical or pneumatic impeller brings about a pronounced loosening of tobacco particles and thus insures that the finely additive can contact all or nearly all particles which enter the contact zone 23 or 123. The cylindrical body 3 or 103 may but need not be provided with internal paddles, blades or like agitating elements which repeatedly lift tobacco particles descending from the contact zone during travel through the drum. The conditioning apparatus may comprise two or more winnowers 7 or two or more nozzles 161.

What is claimed as new and desired to be protected by Letters Patent is set forth in the appended claims:

1. A method of contacting tobacco with at least one additive to thereby change the condition of tobacco, comprising the steps of continuously supplying into a predetermined contact zone at least one spray of finely dispersed additive; feeding a continuous stream of tobacco particles toward a location without said contact zone; propelling across said contact zone a continuous body of at least substantially separated tobacco particles whereby such particles are contacted by and conditioned by the dispersed additive, including propelling the particles of tobacco from said location so that the particles have flight spans extending across said contact zone; measuring the rate of tobacco feed; and changing the flight spans of particles as a function of deviations of said rate from a predetermined rate.

2. A method as defined in claim 1, wherein said changing step comprises increasing the length of said flight spans in response to an increase of said rate beyond said predetermined rate and reducing the length of said flight spans in response to a decrease of said rate below said predetermined rate.

3. A method of contacting tobacco with at least one additive to thereby change the condition of tobacco, comprising the steps of continuously supplying into a predetermined contact zone at least one spray of finely dispersed additive; feeding a continuous stream of tobacco particles toward a location without said contact zone; propelling across said contact zone a continuous body of at least substantially separated tobacco particles whereby such particles are contacted and conditioned by the dispersed additive, including propelling the particles of tobacco from said location so that the particles have flight spans extending across said zone; measuring the rate of tobacco feed; changing the rate of delivery of dispersed additive into said contact zone as a function of deviations of said rate of tobacco feed from a predetermined rate; and changing the flight spans of particles of tobacco as a function of deviations of said rate of tobacco feed from said predetermined rate.

4. Apparatus for contacting tobacco with at least one additive to thereby change the condition of tobacco, comprising means defining a contact zone and including means for continuously supplying into said contact zone at least one spray of finely dispersed additive; means for moving across said contact zone a continuous body of at least substantially separated tobacco particles whereby such particles are contacted and conditioned by the dispersed additive, including impeller means located without said contact zone and conveyor means for feeding a continuous stream of tobacco particles into the range of said impeller means whereby the latter propels the particles thus fed into and across said contact zone, said impeller means being adjustable to vary the length of flight spans of tobacco particles which are propelled across said contact zone; means for monitoring the rate of tobacco feed to said impeller means and for producing signals indicative of the feed rate; a source of additive; an adjustable feeding device for delivering additive from said source to said supplying means at a variable rate; means for adjusting said feeding device in response to said signals; and means for adjusting said impeller means in response to said signals so that the length of flight spans of tobacco particles respectively increases and decreases when the rate of tobacco feed to said impeller means respectively increases and decreases.

5. Apparatus as defined in claim 4, wherein said feeding device is arranged to respectively increase and decrease the rate of delivery of additive to said contact zone when the rate of tobacco feed to said impeller means respectively increases and decreases.

6. Apparatus for contacting tobacco with at least one additive to thereby change the condition of tobacco, comprising means defining a contact zone and including means for continuously supplying into said contact zone at least one spray of finely dispersed additive, said means for supplying additive comprising a plurality of spray nozzles; a source of additive; means for moving across said contact zone a continuous body of at least substantially separated tobacco particles whereby such particles are contacted and conditioned by the dispersed additive, including impeller means located without said contact zone and conveyor means for feeding a continuous stream of tobacco particles into the range of said impeller means whereby the latter propels the particles thus fed into and across said contact zone; means for monitoring the rate of tobacco feed to said impeller means; and means for connecting varying numbers of nozzles with said source as a function of changes in the rate of tobacco feed to said impeller means.

7. Apparatus for contacting tobacco with at least one additive to thereby change the condition of tobacco, comprising means defining a contact zone and including means for continuously supplying into said contact zone at least one spray of finely dispersed additive; means for moving across said contact zone a continuous body of at least substantially separated tobacco particles whereby such particles are contacted and conditioned by the dispersed additive, including tobacco impeller means located without said contact zone and means for conveying a continuous stream of tobacco particles into the range of said impeller means whereby the latter propels the thus conveyed particles into and across said contact zone, said impeller means providing a tobacco trajectory having a flight span and being adjustable to vary the length of flight spans of tobacco particles which are propelled across said contact zone; means for adjusting said impeller means to thereby change the length of said flight spans; means for monitoring the rate at which tobacco is conveyed to said impeller means and for producing signals which are indicative of said rate; and means for actuating said adjusting means in response to said signals.

8. Apparatus for contacting tobacco with at least one additive to thereby change the condition of tobacco, comprising means defining a contact zone and including means for continuously supplying into said contact zone at least one spray of finely dispersed additive; means for moving across said contact zone a continuous body of at least substantially separated tobacco particles whereby such particles are contacted and conditioned by the dispersed additive, including impeller means located without said contact zone and means for conveying a continuous stream of tobacco particles into the range of said impeller means whereby the latter propels the thus conveyed particles into and across said contact zone; means for monitoring the rate at which tobacco is conveyed to said impeller means and for producing signals which are indicative of said rate; a source of additive; an adjustable feeding device for delivering additive to said supplying means at a variable rate; and means for adjusting said feeding device in response to said signals.

* * * * *